United States Patent [19]

Heisler

[11] 4,454,895

[45] Jun. 19, 1984

[54] BAIL ATTACHING APPARATUS

[76] Inventor: Raymond A. Heisler, 657 Dakota Trail, Franklin Lakes, N.J. 07417

[21] Appl. No.: 370,729

[22] Filed: Apr. 22, 1982

[51] Int. Cl.[3] ..... B21F 45/00

[52] U.S. Cl. ..... 140/93 B; 29/432.1; 29/437; 29/798; 29/283.5

[58] Field of Search ..... 140/93 B, 75; 198/836; 29/432.1, 437, 443, 798, 283.5

[56] References Cited

U.S. PATENT DOCUMENTS

| | | | |
|---|---|---|---|
| 3,241,578 | 3/1966 | Heisler | 140/93 B |
| 3,398,711 | 8/1968 | Heisler | 140/93 B |
| 3,444,905 | 5/1969 | Heisler | 140/93 R |
| 3,447,501 | 6/1969 | Heisler | 220/91 |
| 3,462,823 | 8/1969 | Heisler | 29/717 |
| 3,675,305 | 7/1972 | Heisler | 140/93 B |
| 3,874,497 | 4/1975 | Carlson | 198/836 |

*Primary Examiner*—Francis S. Husar
*Assistant Examiner*—Linda McLaughlin
*Attorney, Agent, or Firm*—Ralph R. Roberts

[57] ABSTRACT

This invention pertains to bail applying mechanism particularly for plastic containers with molded-on ears with access openings to the interior of the ear. These plastic containers are usually provided with wire bails when the container is empty. These plastic containers may have their body formed with a taper. "Shingling" of tapered containers is prevented by a guide rail disposed immediately above the transported containers. This guide rail extends through the bail applying station. A backup is also provided when and where the plastic container is provided with molded-on ears having an access opening. This bail applying mechanism may also be used with metal containers with attached sheet metal ears which may be absent apertures for the wire bail or the apertures may be mispositioned if present. This bail applying mechanism has a pair of curling dies, each pivotally secured, and with each die is formed a receiving and retaining recess and there is a reciprocably moved pin which is caused to enter the recess and engage and fixedly position the curling die prior to moving the wire end of the bail to and through the die and into the ear of the container. A cover member is moved into a position in which a groove in the curling die is covered during the forming and inserting of the wire bail end into the ear.

23 Claims, 18 Drawing Figures

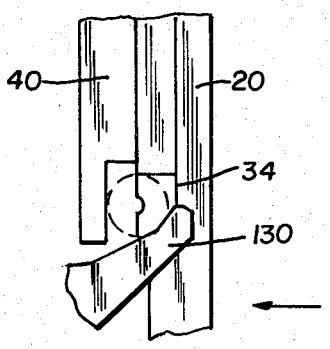
FIG. 12A
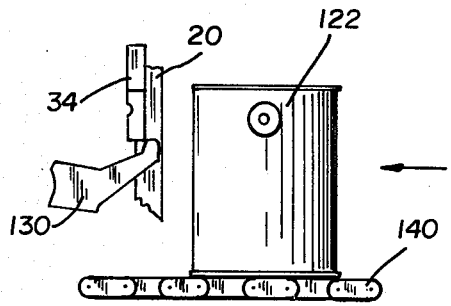
FIG. 12B
FIG. 13
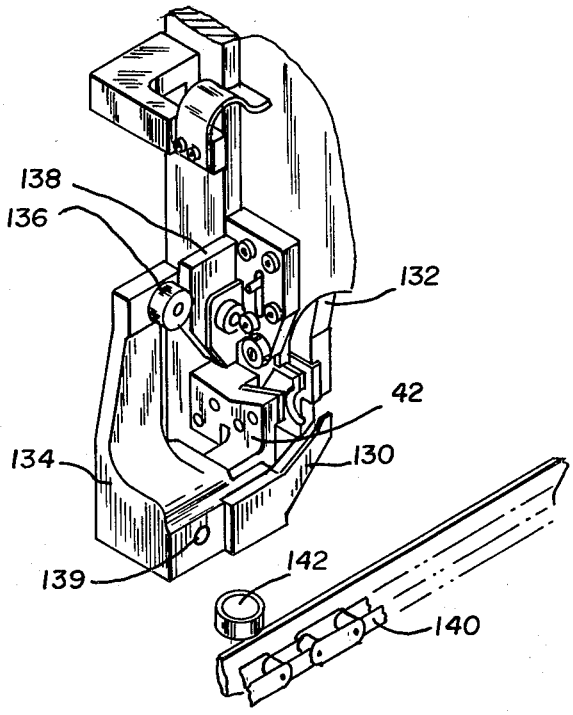

BAIL ATTACHING APPARATUS

BACKGROUND OF THE INVENTION

1. Field of the Invention

With reference to the classification of art as established in and by the United States Patent Office, this invention is believed to be found in the class entitled, "Wireworking" (Class 140) and in the subclass entitled, "applying wire" (subclass 93R) and more particularly to the subclass thereunder entitled, "bailattaching" (subclass 93B).

2. Description of the Prior Art

The attaching of wire bails to pails or containers, either metal (steel sheet) or plastic, has been the subject of many commercial endeavors. Many of these concepts have achieved commercial use and among the most successful is the concept of Applicant's U.S. Pat. No. 3,241,578 as issued Mar. 22, 1966. This patent, to the extent applicable, is incorporated by reference into the present application. This apparatus, in both one and five gallon pail machines, has been sold for use in more than five hundred installations. Assuming at least forty bails per minute for at least fifty hours per week and fifty weeks per year, each machine provides and attaches bails in the several million units per year. In the almost twenty years since the first introduction of this patent apparatus the paint industry has introduced and manufactures a large portion of water based paints. Sheet steel containers are less than satisfactory for storage of such water based paint. Plastic is now used for this paint and mounting of wire bails automatically on these molded pails without effecting a puncture of the side walls of the container must be considered.

The Applicant has made many improvements to the above-identified U.S. patent but these have been directed to inserting wire bails into ears having a preformed aperture and attached ear. A pail or container of plastic with a molded-on-ear present problems if an aperture is to be formed in this ear. Many metal containers also present problems in that the ear forming and the apertures therein are less than commercially acceptable as to positioning limits. These less-than-acceptable ears have caused the jamming of bail applying apparatus as the ends of the bails are often not inserted into the provided apertures. The present invention overcomes these problems.

Curling dies that are used to cause the end of the wire bails to be formed into a loop are shown in the patent above referenced. These dies and others known to the Applicant are contemplated to be used with ears in which an aperture is already formed and present. The inserting of bails with a loop at the end of the bail and with the end within the ear and also causing the formed bail end to make or provide the aperture in the ear has not been shown in prior art devices. The present apparatus and method contemplate moving the end of the bail as it is being formed and guided so as to make and provide an aperture in the ear of either a plastic pail or a metal container having sheet metal ears.

SUMMARY OF THE INVENTION

This invention may be summarized, at least in part, with reference to its objects. It is an object of this invention to provide, and it does provide, wire bail forming and inserting apparatus in which the ends of the wire bail are mounted in opposed outwardly-facing ears secured to the pail. These bail ends and the forming and inserting apparatus curl the wire and are adapted to push the ends of the wire bails through the exterior wall of the ear and loop this end before penetration of the bail end into the inner wall of the pail or container. The curl of the bail secures the bail end in the ear and the continuing curl avoids any puncturing of the adjacent side wall of the pail.

It is a further object of this invention to provide, and it does provide, positioning and engaging means which retain the curling die in a determined position by and in which the curling die guides the wire end to the ear and causes the wire to punch an aperture into the outer wall of the ear while the wire is curled to form a loop within the ear. The loop end is caused to enter the cavity or space between the inner and outer walls at the ear and to secure the bail without puncture of the inner wall of the pail or container.

It is a further object of this invention to provide, and it does provide, an apparatus that enters that space between the sidewall of the pail and ear outer wall and provides a metal stop plate to insure that the entering end of the bail does not puncture the side wall of the pail. This deflector plate is moved by pneumatic means which is also used to advance a tapered pin into a receiving aperture in the curling die. This tapered pin enters the aperture before the end of the wire is pushed to and through the curling die and into the ear. This tapered pin, when placed in the desired securing position, insures that the discharge end of the wire is adjacent and in the predetermined position for making a puncture of the ear.

In brief, this apparatus provides alteration of the conventional apparatus as shown in U.S. Pat. No. 3,241,578. The apparatus of this invention, in one embodiment, is used for plastic pails or containers in which ears are molded in place and are open toward the bottom of the pail. These ears do not have previously formed apertures so the entering bail end is used to punch an aperture in said ear outer wall portion. This same aperture may be used to punch an aperture in the outer side wall of an ear of a metal pail having an attached ear.

In the apparatus used with a plastic pail with molded ears without a formed transverse aperture, the present invention provides a backup that prevents accidental and unwanted penetration of the inner sidewall of the pail or container. Usually this preventing backup is not required put provides insurance when unusual conditions occur. Where and when the ear is metal and attached to a metal pail or container the end of the wire forms an entrance without a problem. The lack of accuracy in the placement of the attached metal ear and the forming and providing of an aperture encourages the use of the present apparatus in which the end of the wire bail enters the ear with or without an aperture.

The apparatus in this invention provides a reciprocated pin that is moved by a pneumatic cylinder prior to the entrance of the end of the wire bail into the curling die. This die is additionally formed with a tapered seat into which this pin is moved to position the die in the desired placement to insure and guide the end of the bail end to and through the outer wall of the ear. The end of the bail forms the aperture and then enters the ear and curves upwardly to provide the retaining configuration as described in the reference patent.

The present invention shows the curling die with a cover plate that is moved into and from the die cover condition. This curling die is pivotally supported and the downward and curving formation into and of the wire causes the pivoted die to be moved toward and to the ear. This invention provides apparatus that positively positions and fixes the curling die adjacent the ear prior to the action of the wire. It is to be noted that the invention includes apparatus that provides a backup when the bail end is to be forced into an ear such as that which is integral with the molding of a plastic pail. Where the pail is plastic, the bail is formed with an offset that prevents unwanted spring-back of the bail and a resulting out-of-round condition of the bailed pail. This same formed bail may be used with metal pails. Metal pails or containers with metal ears may also have bails formed substantially as in the reference patent.

When the pail or container is of plastic, the bail is inserted through the exterior wall of the ear and a backup prevents unwanted engagement of the bail end to the inner wall. The apparatus shown hereinafter is modified from the conventional apparatus to provide bails on earred containers. The plastic pail is often bailed before filling with the product and the turning conveyor means must be altered to accommodate this light weight container. This change in apparatus includes using plastic belts of resilient material such as polyproplyene polyethylene and the like. It is desirable that the belts have a high coefficient of friction to produce a frictional engagement with the bottom of the container and to advance and rotate the container so as to present the ears of the container to the bail applying mechanism as described in the above-identified patent.

When and where the pail or container is of plastic the container is often molded with a taper and with the taper extending from the larger open end toward the smaller bottom portion, Such containers, when abruptly stopped, tend to "shingle" and since this prevents controlled advance and rotation the applying is further modified to control the attitude of these plastic pails or containers. In the apparatus to be hereinafter more fully described the modified apparatus contemplates the use of the principal motions and apparatus of the above referenced patent.

The apparatus of this invention positions the pivoted end forming dies adjacent the ear and fixedly retains the ears before and during the advancement of the wire bail ends to and through the curling dies and then into the interior of the ear.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been shown two bail inserting mechanisms for holding fixture and trimmer for PC boards as adopted for use for both plastic and metal containers with ears having no apertures or mispositioned apertures and showing a preferred means for forming and inserting said bails. This specific embodiment has been chosen for the purposes of illustration and description as shown in the accompanying drawings wherein:

BRIEF DESCRIPTION OF THE DRAWINGS

FIGS. 12A and 12B represent ear lifting apparatus by which a metal ear is centered and with a lifting action imparted to the container to provide for a bail end to enter the central portion of the ear;

FIG. 13 represents a fragmentary and partially diagrammatic isometric view of the curling die provided with a container lifting finger means.

Figure 1:
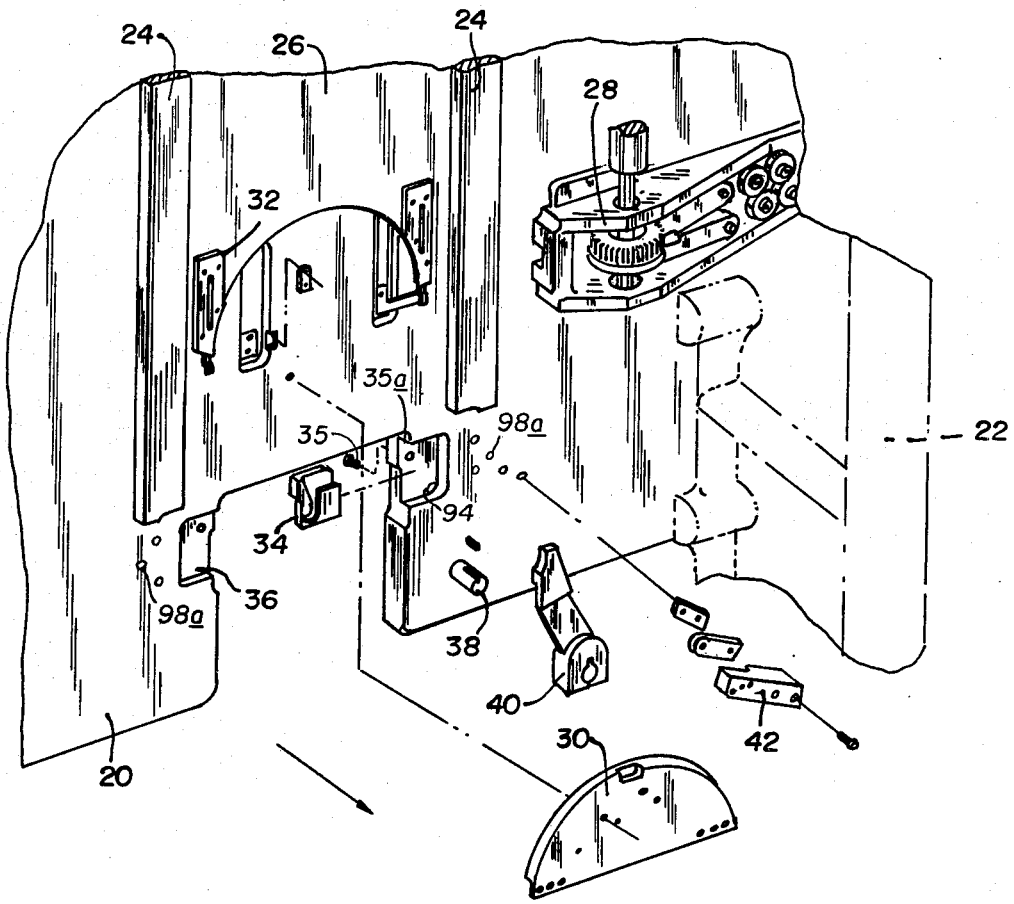
FIG. 1 represents a fragmentary and partly diagrammatic isometric face view showing the front plate and associated components used with bail applying mechanism of this invention.

Embodiment of FIG. 1

In the embodiment of FIG. 1 a general arrangement of the several components of the bail applying mechanism is as shown in the above-identified U.S. Pat. No. 3,241,578. This assembly includes a main plate 20 carried by end or side frames 22 which are conventionally of cast iron. This main plate carries slide guides 24 in which an upper die 26 is reciprocated by mechanism including a crank shaft shown in the above-identified patent. A wire feed and straightener apparatus 28 feeds wire from a coil supply to and into a receiving groove. The wire is then cut to a selected length. A lower die shoe 30 is shown in this FIG. as are the wire retaining means 32 and a curling die 34. This curling die 34 is made right hand and left hand as mirror images of each other and are pivotally carried by shoulder screw 35 passing through a compatibly formed hole 35 a formed in main plate 20. Pivot support of this curling die 34 is particularly shown in FIGS. 36, 37 and 38 of U.S. Pat. No. 3,241,578 above referenced. This die has its lower portion formed with a positioning and tapered recess 90 (FIG. 8) for apparatus to be hereinafter more fully described. Pockets 36 are formed in this main plate to provide a receiving means for the curling die 34. A hole for bushing 94 (FIG. 8) is shown at the lower inner portion of this recess and pin 92 is cycled in said bushing. A shaft 38 moves a cover arm 40 back and forth by pneumatic means not shown. A cover retainer 42 is provided and is attached to the main plate so as to prevent the cover arm 40 from being displaced from the desired position.

Figure 2:
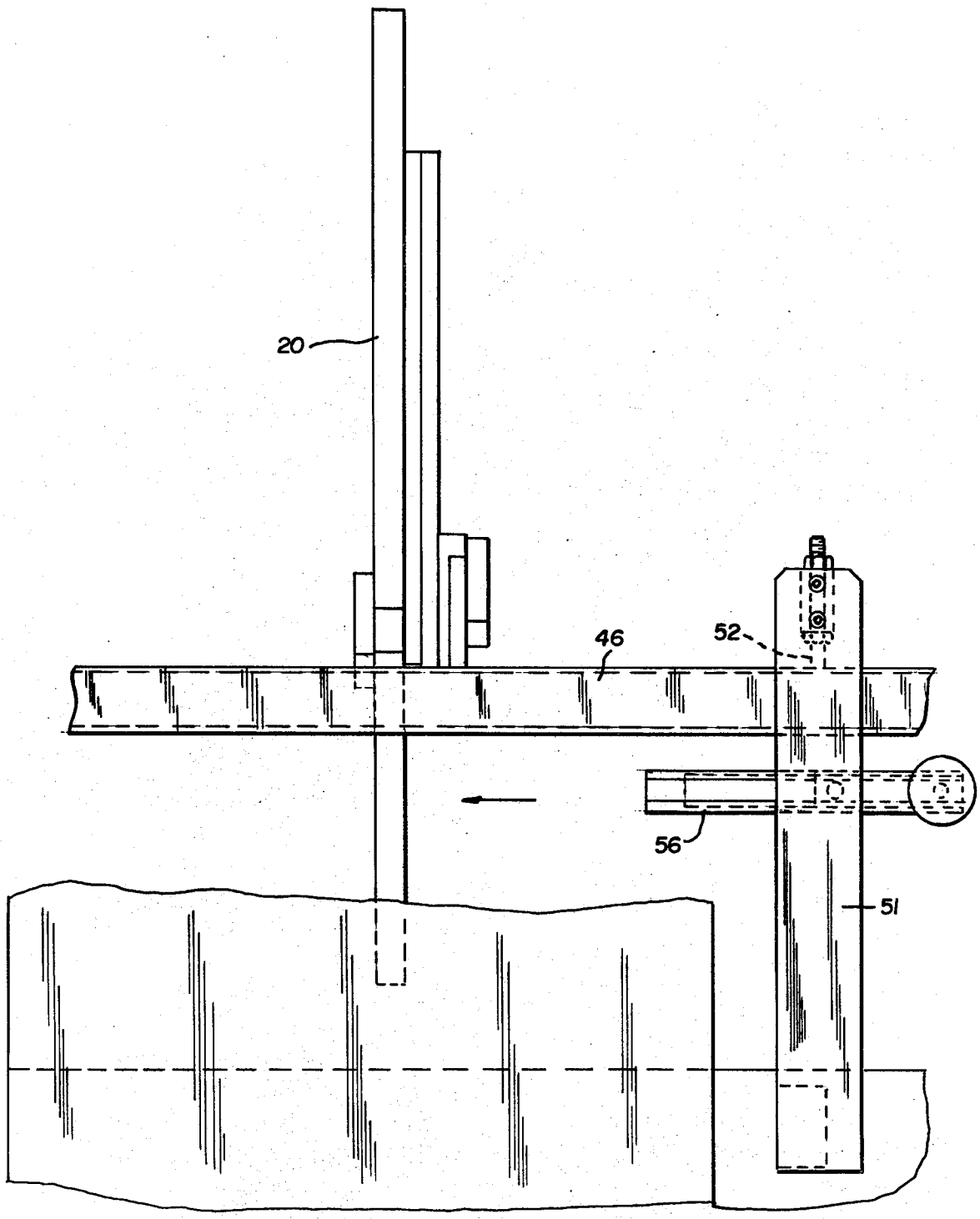
FIG. 2 represents a partly fragmentary and diagrammatic plan view of mechanism providing transport of a plastic container to and through the bail applying mechanism.
Figure 3:
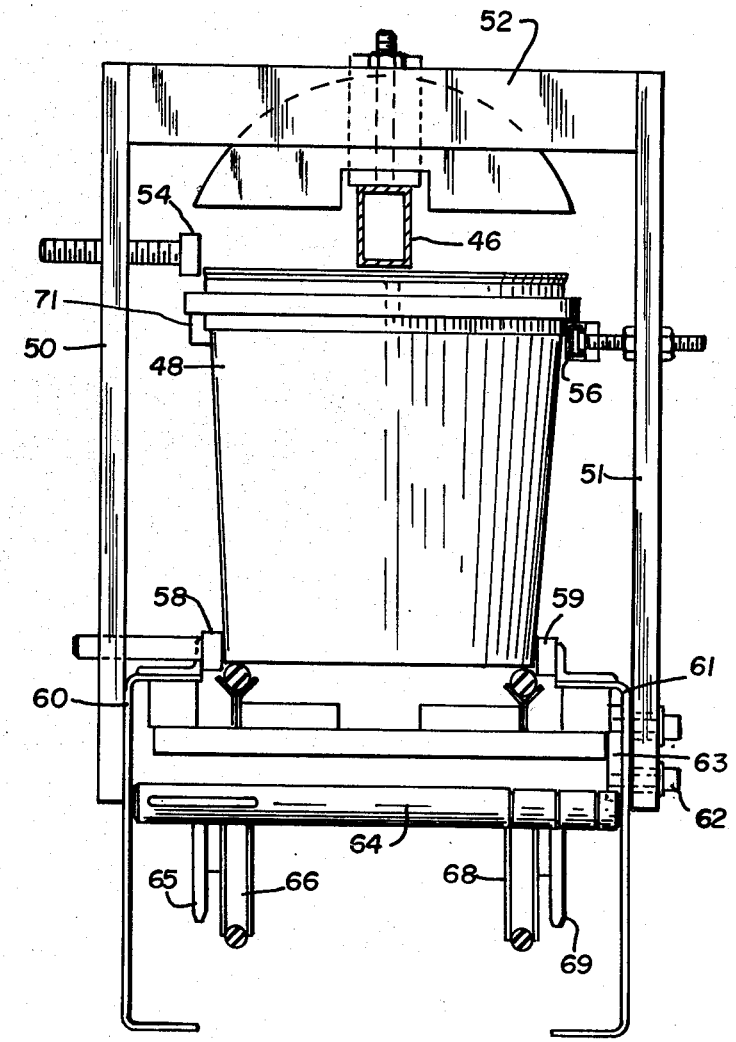
FIG. 3 represents a sectional transverse view, partly diagrammatic, of the container transporting mechanism of FIG. 2.

Embodiment of FIGS. 2 and 3

In the plan view shown in FIG. 2 the main plate 20 is formed with a cutout for a rectangular tubular guide 46 which is disposed to prevent a tapered configurated plastic container 48 from being dislodged or lifted from its bottom supporting surface. This rectangular tube is carried by side supporting members 50 and 51 which are attached to a transverse support 52. This tubular guide is adjusted to be slightly above the top rim of the plastic container 48 so as to prevent unwanted tilting of the container. As seen in FIG. 3 a side guide member 54 is adjusted to position the top rim of the plastic container 48. On the opposite or right side, as viewed in FIG. 3, is a stop rail 56 which is adapted to engage one of the ears of the container and by means of a turning motion imparted by the propelling apparatus this container is advanced and rotated as in the above-identified patent.

Still referring to FIG. 3, it is to be noted that the small side guides 58 and 59 center the pail at its bottom. These guides are carried by channels 60 and 61 which are secured to main plate 20. Channels 60 and 61 also carry side supporting members 50 and 51 by cap screws 62 and threaded blocks 63. Still referring to FIG. 3, the propelling apparatus includes a shaft 64 on which is mounted a drive sprocket 65 and an attached V-trough pulley 66. Also freely rotating on this shaft is a like V-trough pulley 68 moved in concert by sprocket 69. This container 48 has an ear 71 which is molded as part of the container and is open at the bottom. Positioning and supporting of this container is by means of the side guide members 58 and 59 as seen in FIG. 3 and by belts as in FIGS. 4 and 5.

Figure 4:
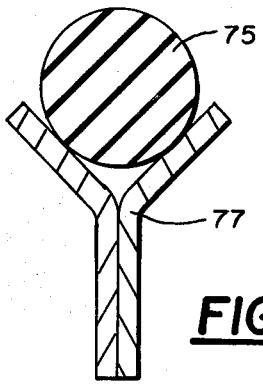
FIG. 4 represents a slightly enlarged fragmentary sectional view showing a support and a round plastic endless belt used therewith.

Belt and Support of FIG. 4

In FIG. 4 there is depicted a round belt 75 that is made of plastic such as polyproplyene or polyethylene. Each belt is made of a selected length and is made endless by hot melt joining which is conventional. As shown is a slide guide for this belt which includes right and left like bent metal members joined to form a slide retainer 77 of selected length. Of note is that this slide is made with about ninety degrees included angle which is not a gripping angle but a support and guide. There are provided tensioning means to maintain the two belts and the drive chains used therewith at the desired taughtness.

Belt Advancing and Drive as in FIGS. 5A, 5B, 5C and 5D

Figure 5B:
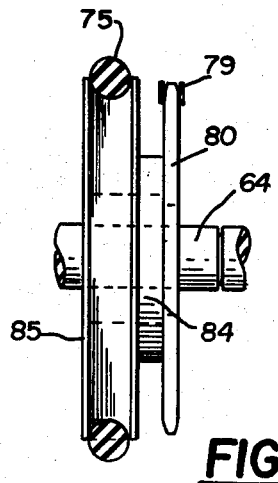
FIGS. 5A, 5B, 5C and 5D represent fragmentary sectional views for transporting and positively advancing a round plastic belt used with the advancing and turning of a plastic container.
Figure 5A:
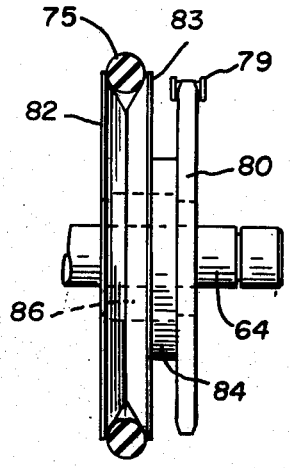

In FIGS. 5A and 5B there are depicted two drive sheaves adapted to advance the round belt 75. This belt is advanced at a determined speed by a roller chain 79 carried and advanced by a sprocket 80. This sprocket is secured to and rotates a drive sheave for the round belt. This drive sheave in FIG. 5A has a V-groove portion made of like metal members 82 and 83 which are secured to a hub and spacer 84. As an alternate, construction in FIG. 5B may have the groove formed in a metal disk 85 which may also be secured to a hub 84. One end of the drive assembly is made free turning so a bearing 86 is shown in the hub 84. Shaft 64 carries this drive means. The other end of the chain 79 is driven by motor means not shown.

Figure 5C:
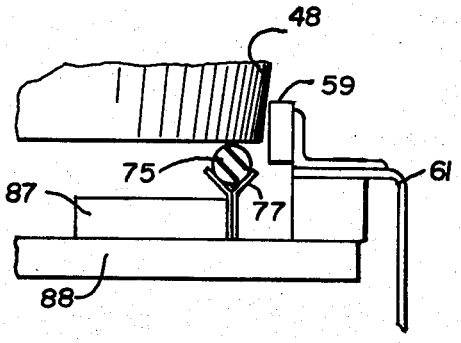

In FIG. 5C there is depicted the slide retainer 77 secured to a supporting block 87 which is carried by a support bridge 88 secured at each end to blocks 63. Fragmentarily shown and depicting the arrangement of the several components is guide 59 which engages the side of the container 48. It is to be noted that the plastic container 48 is usually very light in weight before filling and hence the belt 75 slides very easily in slide retainer 77 and deflection is not a problem.

Figure 5D:
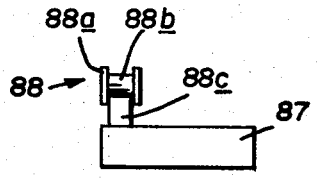

In FIG. 5D there is depicted an alternate slide guide to the member 77 shown in FIG. 4. In this embodiment side plates and a bottom support member provides a guide and bridge support 88 for a belt. This guide is attached to block 87 as in FIG. 5C. If and when the container is filled or the conainer is of metal the support and advacement is by chains as in the referenced patent and the support bridge and guide 88 is as shown with side plates and a roller support member. These side plates are identified as **88*a* and 88*b* and the support member as 88*c***.

It is to be noted that the belt 75 as it is wrapped in a semi-circular path around a pulley or sheave provides a high degree of friction but with a straight transport and a light load from the container the belt 75 is advanced at the desired speed. In a later FIG. the two belts or chains and their relationship to the propulsion and turning of an earred container is illustrated and noted.

Figure 6:
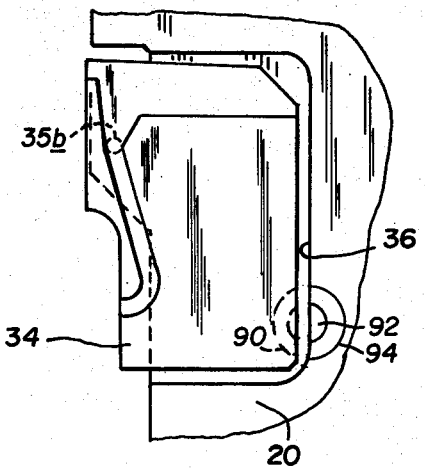
FIG. 6 represents a face view of a curling die for a bail wire end with this die modified to provide a positive positioning means before the wire end is brought to the die.

Curling Die as in FIG. 6

In FIG. 6 the curling die 34 is illustrated with its rear portion formed with a tapered recess 90 for engagement by a pneumatically actuated pin shown and described with FIGS. 7 and 8 hereinafter. These dies are modified and are pivotally carried as in the reference patent. A threaded blind hole **35*b* is formed in this die which received the threaded portion of shoulder screw 35**. These curling dies are made with both right and left hand configurations and as shown have cutouts to accommodate the extending ears of the container. Whether the container is of plastic and empty or filled or of metal the tapered pin securing means is actuated before the wire ends enter the shaping groove provided in the dies.

Figure 7:
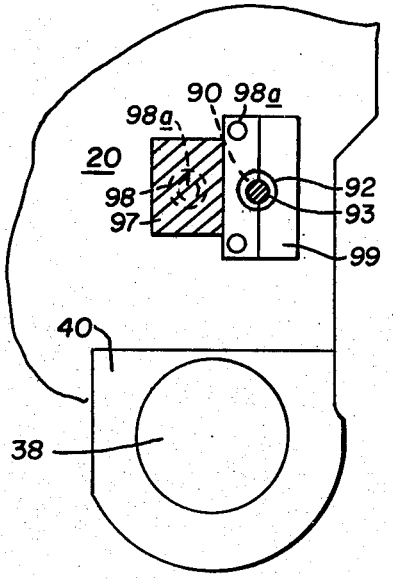
FIG. 7 represents a fragmentary and partly diagrammatic view of the positioning apparatus which is actuated before the wire bail end is advanced to and through the curling die and with this view looking toward the main plate and taken on the line 7—7 of FIG. 8 and looking in the direction of the arrows.
Figure 8:
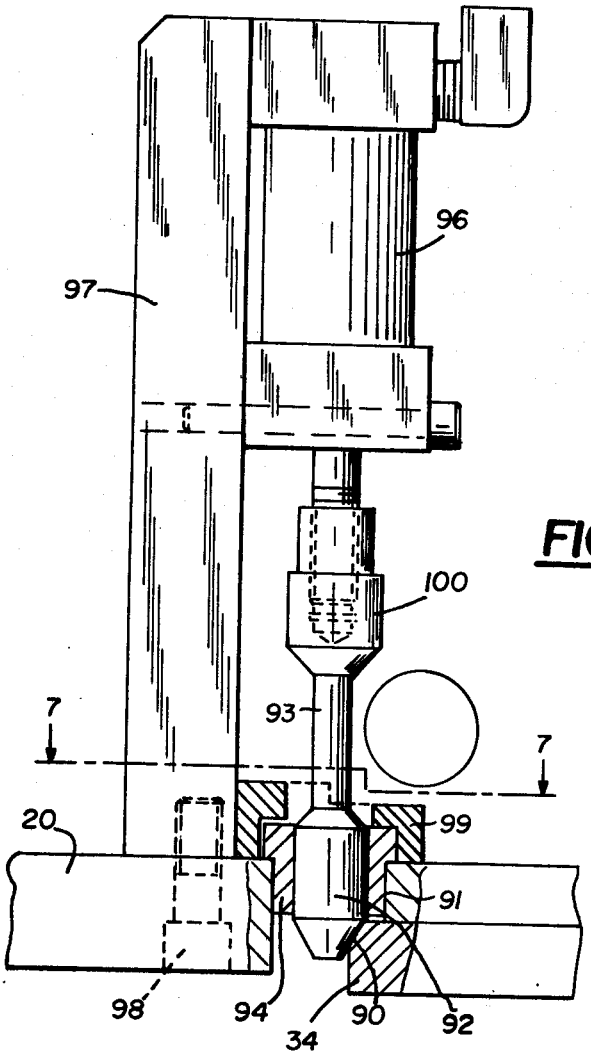
FIG. 8 represents a plan view, partly fragmentary and diagrammatic, of the tapered pin and its actuating mechanism in and of FIG. 7.

Pin Engagement and Retention of the Curling Die as in FIGS. 7 and 8

In FIG. 7 there is fragmentarily and diagrammatically shown a secured bearing block 140 in which is rotated shaft 38 and moves the pivoted cover arm 40 on shaft 38. Also seen in FIG. 7 is a right hand curling die 34 with a tapered recess formed in its back and identified as 90. Although the apparatus for actuating a pin is preferably by pressurized air, this does not preclude hydraulic and solenoid actuation. A bore 91 is formed in plate 20 and is aligned for tapered pin 92 which is reduced in its shank portion 93 and is cycled in a shouldered bushing 94 mounted in hole 91. This tapered pin serves as a cam means and engages the recess 90 to position the curling die against the ear of a container. This tapered pin is actuated whether the container is plastic or metal.

In FIGS. 7 and 8 the means for actuating this pin 92 is shown and a timed reciprocation back and forth is made in response to the presenting of a container in the bail applying mechanism. As seen in detail in FIG. 8 the reduced shank portion 93 of, pin 92 is carried in an anti-friction shouldered bushing 94; and is reciprocated back and forth by a cylinder 96 actuated in response to signals from a control circuit not shown. This cylinder 96 is carried by a support bracket 97 and secured by cap screws 98 through appropriate holes 98*a* to the main plate 20. In FIG. 7 the pivoted cover arm 40 is shown and a reduced shank portion 93 provides the required clearance for the reciprocated movement of pin 92. Plate 99 is depicted secured to rearwardly extending bracket 97. A plurality of holes 98*a* are provided in plate 20 for securing bracket 97 and plate 99 by screws 98 to plate 20. Plate 99 is preferably attached to bracket 97 as by welding. Appropriate boring and counterboring to accommodate pin 92 and bushing 94 is depicted. An adjusting member 100 is provided so as to have this pin 92 precisely engage the tapered recess 90 in the modified curling die 34. It is to be noted that the tapered pin 92 enters the recess 90 to position the die at the precise position against the ear of the container. The pivot support and its purpose for this die is stated in the reference patent.

Figure 9:
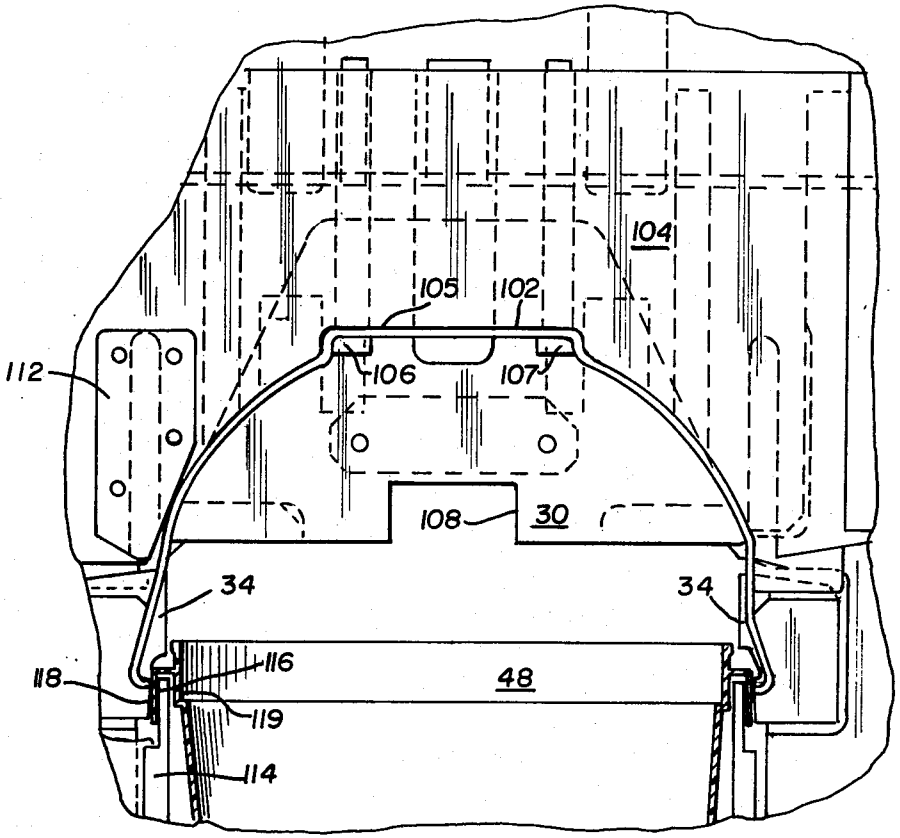
FIG. 9 repesents a face or front view, partly fragmentary and diagrammatic, of bail forming and inserting apparatus as modified for inserting wire bail ends into plastic containers with ears thereof having open bottom portions and external walls with no apertures.
Figure 10:
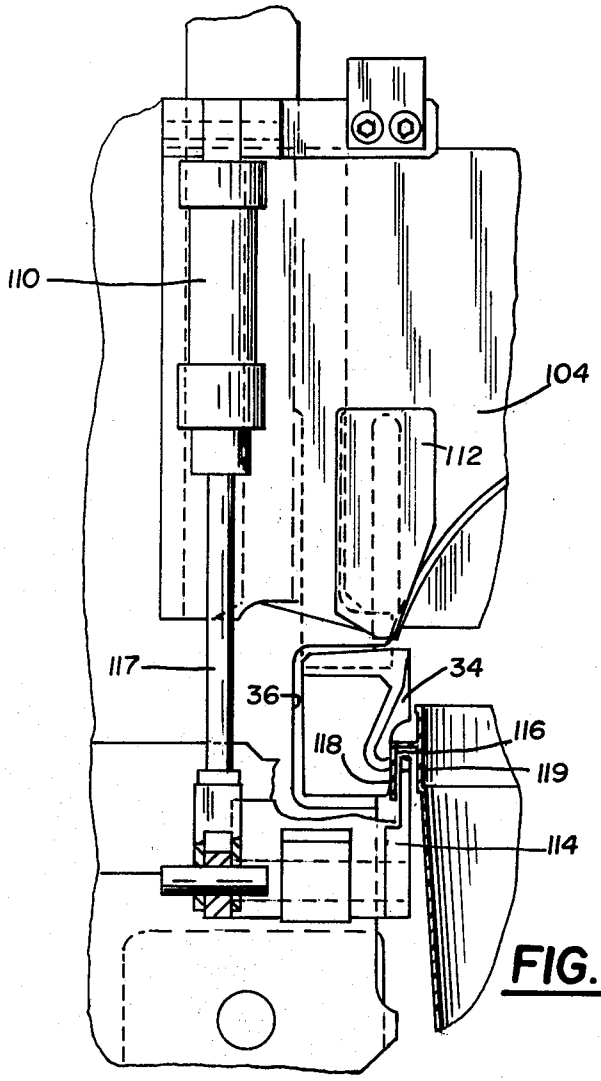
FIG. 10 represents a face or front view partly fragmentary and diagrammatic of pneumatically actuated mechanism which reciprocably moves in and with a timed response a back-up member into and from the ear of the container.

Bail Applying Mechanism as in FIGS. 9 and 10

In FIGS. 9 and 10 there is a more-or-less diagrammatic showing of a wire bail formed by upper and lower dies and for mounting a plastic container 48. So as to prevent unwanted spring-back of the mounted wire bail a wire 102 as in FIG. 9 is formed between an upper die 104 having a central receiving offset 105 and a lower die 30 as seen in FIG. 1. Extending support and forming members 106 and 107 engage and are supported by the upper forming surface of the lower die 30. These members provide the offset forming of the wire bail and provide a straight central portion between the two curved end extents of the wire bail.

The lower die 30 is made with a cutout 108 through which the rectangular tubular guide 46 (FIG. 2) extends to engage the open top of the container to prevent lifting, tipping and the like. As seen in FIG. 9 and particularly in FIG. 10, like air cylinders (only one is shown) 110 are carried on the main plate 20 and each cylinder actuates a reciprocated rod 117 which moves a backup member 114 into and out of the inner ear portion 116 attached as by molding to the container 48. When and as the upper die 104 is moved downwardly it carries the wire length 102 to and between the upper and lower dies to form the bail with the end portions extending downwardly. As shown on the left portion of this FIG. 9 and in FIG. 10 the wire is prevented from forward escape by retaining member 112. There is a like member 112 on the right side of the view of FIG. 10 which member is omitted in this view. The extending ends of the wire bail enter the curling dies 34 which have previously been fixedly positioned by a tapered pin 92 as it enters and engages the recess 90 in the die 34. The end of the wire exits from the pathway in the die where it is curved and enters the exterior side of ear 118. This wire end may form its own aperture in the wall of the plastic ear in which the backup member 114 insures that the entering end of the bail wire does not accidently puncture or otherwise damage the interior wall 119 of the container 48.

It is to be further noted that the backup member 114 is used with plastic pails with the ear portions having an access or opening to the interior of the ear. The exemplified construction is with the molded ear having the interior formed by a portion of the mold and with the opening toward the bottom of the container but other access openings may be provided and the placement of the backup would be adapted for actuation in accordance with the construction of the ear and container. Where and when the ear is of metal and is attached to a metal container the exterior wall may or may not have a formed aperture. If the ears have no formed aperture the container may require a backup from the open top which could be provided by pneumatic means. Also contemplated is gripping means that may in part be carried by the cover arms and in part be provided by pivoted supports that engage the container upstream of the conveyor. Such construction is special to the particular configuration and composition of the container or can.

Figure 11:
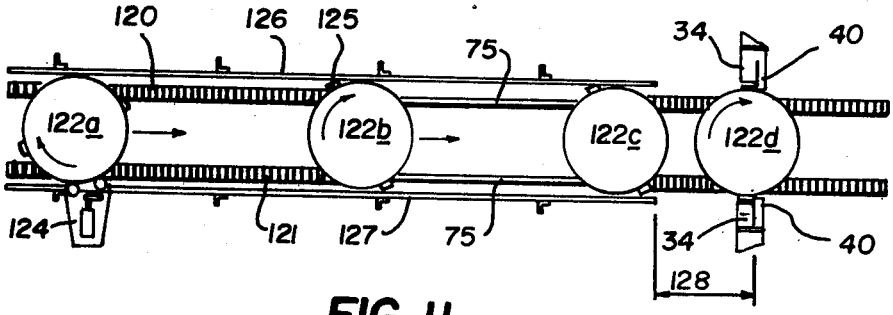
FIG. 11 represents a partly diagrammatic plan view depicting the arrangement and advancing motion of two chains or belts for transporting containers toward and to the bail applying mechanism.

Container Propulsion and Rotation as in FIG. 11

Referring next to FIG. 11 and the diagrammatic showing of the method for advancing and rotating the containers, the mechanism employs two endless strands with strand 120 travelling at a faster speed than strand 121. As reduced-to-practice, this differential in speed may be three-to-four or two-to-three and this differential is merely a matter of preference. Strand 120 may be a roller chain which transports any filled containers or empty metal container on its bottom. These container positions are identified as 122*a*, 122*b*, 122*c* and 122*d*. It is desired and necessary that the containers be spaced so as to permit rotation without interference. A container spacer mechanism 124 releases one container at a time. Container 122*a* is shown at the point of release from this spacer mechanism.

strands 120 and 121 carry this container forward with a rotative motion as indicated by the arrows until a protruding ear 125 engages a rub rail 126 or an opposite rail 127. When an ear engages a rub rail rotation ceases and the container moves forwardly as depicted at position 122*c* until the container has reached the end of the rub or orientating rails. Depending on the speed of the strands and their differential the container is then released to again rotate and the ears 125 are brought to the curling dies 34 and the cover arm 40 whereat the wire bail is inserted into the ears.

it is to be noted that the strands 120 and 121 are shown as chains for a portion of this FIG. 11 and as round belts 75 for another portion. Whether chains or belts, this arrangement provides for forward transport of the containers and their rotation in a controlled manner. When and where the containers are empty plastic moldings with a tapered configuration as in FIG. 3 "shingling" may be anticipated and so with the strands shown there is also the rectangular tubular guide member 46 which is positioned above the containers to prevent tipping. These strands 120 and 121 are maintained in a taut manner by tightener means not shown. The strands are moved by the same power means and by roller chain drives and sprockets. Positive transport and rotation depends on a frictional relationship of the container and strands. Particular conditions may require special strand construction but the transport is substantially as shown with the release of the container from the orientating rub rail to the curling die adjusted to provide the desired rotation to bring alignment at the curling dies. See distance identified as 128.

Ear Lifter as in FIGS. 12A and 12B

When and where a metal container has a closed ear there is conventionally provided a lifting means used when a container 122 is empty. As seen in FIG. 12A the pivoted curling die 34 is carried by the main plate 20. The cover arm acts in concert with the curling die to provide a guide retainer for the wire bail end. Since containers often have small irregularities such as dents, etc., the location of the ear may be out of tolerance and so a lifting and positioning attachment is provided. A lifting finger or insert 130 is to be actuated as a container is brought to the bail inserting position. As seen in FIG. 12B the empty container 122 is moving from right to left and the finger 130 is moved only after the ear has engaged the cover arm 40.

Lift Mechanism as in FIG. 13

The fragmentary and diagrammatic isometric view as in FIG. 13 shows a typical ear lifting and positioning apparatus. A cutout 132 is provided for forward movement of the ear. An actuating arm 134 is pivotally retained on the cover retainer 42. A cam follower 136 is actuated by a plate cam 138 and as said plate cam is moved up and down the lifting finger 130 is moved in an arc cam about the pivot pin 139. The position of FIG. 12A shows finger 130 as with the cam plate 138 in the down position. The transport shown contemplates a roller chain 140 and is shown in FIGS. 12B and 13. Shown in this view of FIG. 13 is a chain height adjusting knob 142 that adjusts the transport level of the chain and the container as it rests on its bottom.

Figure 14:
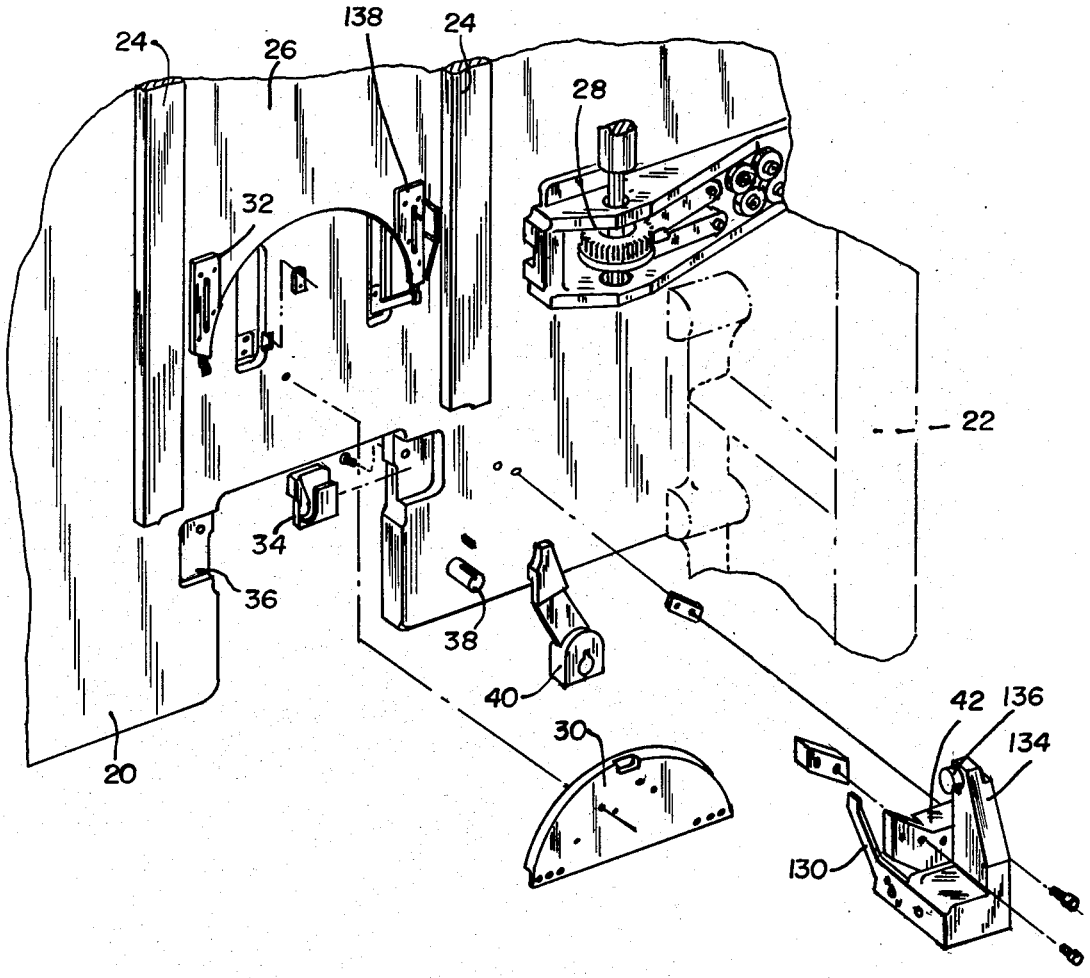
FIG. 14 represents an isometric view, partly exploded and diagrammatic and showing the lift finger apparatus of FIG. 13 as arranged for assembly to bail applying mechanism.

Lifter Assembly as in FIG. 14

Referring next and finally to FIG. 14, the container lifter mechanism is shown in an exploded isometric view which is partly diagrammatic. As shown, FIG. 14 is much like FIG. 1 but the lifting insert of FIGS. 12A, 12B and 13 are shown with the associated mechanism. As in FIG. 1 there are shown the guides 24 and upper die 26 as well as lower die 30, curling die 34 and pockets 36. The cover arm 40 is rotated by shaft 38. Cover retainer 42 also carries the member 134 and the cam follower 136 rotatably mounted thereon. As the upper die moves downwardly the cam 138 engages the cam follower 136 and causes finger 130 to be lifted upwardly. The movement of cover arm 40 releases the bailed container to a discharge point.

The above specification discloses a bail applying mechanism in which the ends of the wire bails are caused to enter a curling die and to be then curved so as to enter the outer sidewall of the attached ear. The bails with this curve enter the interior area within the ear and retain the container in a pivoted and retained relationship. In all circumstances the curling die 34 is retained in a fixed position by the actuated pin as it enters the tapered recess in this die before the wire end exits from the die. Preferably this pivoted die 34 is secured against the ear before the end of the wire enters the curling die. This actuation is contemplated with plastic containers both filled and empty and with and without a tapered sidewall. When and where the container is of metal the ear may have an aperture previously formed therein and with said ear or aperture misplaced. There may be also a condition in which the ear is without an aperture both deliberately and/or unintentional. This prepositioning and securing of the die is intended to provide a satisfactory mounting of the bail in the adjacent ear.

Where and when plastic containers have tapered sides and are empty, round belts as in FIG. 4 are provided and the transporting apparatus as in FIG. 11 is adapted for belt use as above discussed. "Shingling" is prevented by the arrangement of FIGS. 2 and 3 and the tubular guide 46 is a convenient means for providing such a control. This does not preclude other control means but the depicted apparatus permits adjustment with little cost and wear. The formation of the ear on the plastic container is merely a matter of selected design and no patentable significance is ascribed thereto. The forming of the wire bail with a straight central portion as in FIGS. 9 and 10 provides a bail with the desired applied results and with an absence of springback. This permits the bailed plastic containers to be packaged and transported for later filling and cover mounting.

The drive of the transport chains or belts at a differential in speed has been shown in the above-identified patent and this application but other drive systems may be provided including pneumatic drive means with electronic speed control. The use of plastic round belts is noted but rubber or rubber belts with fabric tension member portions made as endless belts are also contemplated.

The apparatus used for bail applying prior to the particular alterations as in the above application includes mechanism as in the above identified patent and others not issued. Included is ear detection means in combination with a container supply. The ear when of metal is usually with this center line of an aperture therein within one-thirty second of an inch from the exit of the wire bail. Excessive displacement from this desired location may require applying bails to ears without apertures or misplaced apertures as above noted. As a part of this bail applying apparatus a wire cutoff and straightener is provided for wire delivered from a reel supply. A snarl detector is also contemplated to be provided and there is also added apparatus whereat an additional handle grip is provided. The above is not exemplified in this application for pivoted curling dies with means to position and secure said pivoted die before actuation by the entrance and movement of the wire end in and through the curling die are described in 3,241,578.

It is to be noted that the tapered pin 92 and the bearing 94 providing the forward guide of this pin are merely a preferred construction. Other means are contemplated and may be used including forming or attaching a pin to the curling die and providing a complimentary movable member as with a hole. Means for moving the backup into position may be by mechanical means if desired. The control circuit is not shown for the several components that are pneumatically actuated as the control circuit is a matter of specific application and preference.

The backup member 114 as shown in FIGS. 9 and 10 is depicted as moved by a cylinder 110. This backup occupies the space normally utilized by the ear lifter of FIGS. 12A and 12B. This backup may also be moved mechanically or by a solenoid. The entering portion of the backup is shaped to accommodate the wire bail end and may be particular to the shape of the ear. The ear lifting mechanism may or may not be required to insert wire bail ends into the metal ears of metal pails. When molded ears on plastic pails or containers are present the backup is provided as an insurance or safety and usually replaces the ear lifter when plastic containers have attached wire bails.

It is also to be noted that the wire used as a bail is usually of tempered steel and of a determined diameter with or without an antirust coating. The final configuration of the wire bail is a matter of preference and aesthetics. The bail on the metal container may be in arc or with a configuration similar to that shown in FIG. 9 and the final configuration is a matter of preference. The speed of transport and spacing of the containers is also subject to the size and contents of the container and as to whether the container is empty, partly filled or completely filled.

Terms such as "left," "right," "up," "down," "bottom," "top,""front," "back," "in," "out" and the like are applicable to the embodiments shown and described in conjunction with the drawings. These terms are merely for the purposes of description and do not necessarily apply to the position in which the bail applying mechanism with selective securing of the pivoted curling dies may be constructed or used.

While particular embodiments of the bail applying mechanism have been shown and described it is to be understood the invention is not limited thereto and protection is sought to the broadest extent the prior art allows.

What is claimed is:

1. Bail applying mechanism for transporting wire from a supply source into said mechanism and cutting this wire into a determined length and then between upper and lower die members bending the cut wire into a selected bail shape in a single plane and then applying a wire bail to a container and having two opposed ears attached to the sides of said container with each ear having an outer wall spaced from a side wall of said container, said applying mechanism including: a support means;

a main plate carried by said support means;

a pair of curling dies pivotally carried by said main plate, the dies arranged as mirror images of each other and with each having a groove with an entering and an exiting end and therebetween a curved portion of more than ninety degrees, said die and its formed groove adapted to receive an end of a wire bail and as the wire end is moved through said curling die the wire is bent into a loop with the loop end of said wire bail exiting at a determined position and then entering said ear so that the end of the bail penetrates this outer wall of the ear and then continues to curve within the interior of the ear so as to provide a retaining loop end;

cam means engaging said curling die for pivotiing said curling die to a position adjacent the ear prior to moving the wire into and through said curling die a cover member on said plate;

means on said plate connected to said cover member for actuating said cover member so as to provide a confining wall for the groove in said curling die as the wire end is being moved in said groove and to uncover said groove after the wire end has been formed and inserted into an ear;

means on said support for transporting successive containers on their bottoms to and through the bail applying mechanism, and said means for transporting includes means for rotating each container until an ear of the container is brought into a desired orientation at which orientated position the container is advanced to a delivery position whereat the container is delivered to the bail applying mechanism.

2. Bail applying mechanism as in claim 1 in which said cam means is a tapered pin and the entering end of said pin engages a tapered recess partially formed in the curling die.

3. Bail applying mechanism as in claim 2 including means connected to said pin for reciprocably moving said pin.

4. Bail applying mechanism as in claim 3 in which the said moving means is a pneumatic cylinder which is secured to a bracket attached to the main plate.

5. Bail applying mechanism as in claim 4 in which said means for moving the tapered pin includes adjusting means by which the forward motion limit of said pin is precisely determined and fixed.

6. Bail applying mechanism as in claim 5 in which said pin is carried by and in a bearing means to precisely position the forward portion of the pin as it is reciprocated.

7. Bail applying mechanism as in claim 2 in which the means for transporting said containers are two endless chains.

8. Bail applying mechanism as in claim 7 in which the chains are roller chains and with the upper extents of each of these chains carried by supporting slide means disposed to engage the roller portions of each of the roller chains.

9. Bail applying mechanism as in claim 7 in which said cover member is maintained as to the groove in a curling die by retaining means secured to the main plate and an ear lifting and positioning means includes an actuating arm which is disposed to engage and lift an associated ear into a precise position as the wire bail end is moved to and through a curling die.

10. Bail applying mechanism as in claim 9 in which the actuating arm is pivotally carried by attaching means to the main plate, said arm having a cam follower mounted thereon, this cam follower disposed to be actuated by a linear cam carried by the movable upper die.

11. Bail applying mechanism as in claim 7 in which said transporting means includes a container spacing or metering means disposed to receive containers and release said containers with a determined spacing between successive containers.

12. Bail applying mechanism for transporting wire from a supply source into said mechanism and cutting this wire into a determined length and then between upper and lower die members bending the cut wire into a selected bail shape in a single plane and then applying a wire bail to a molded plastic container having two integrally molded-on ears, each ear having an access opening provided between the ear and the sidewall a support means outer wall, said applying mechanism including:

a main plate carried by said support means;

a pair of curling dies pivotally carried by said main plate, the dies arranged as mirror images of each other and with each having a groove with an entering and an exiting end and therebetween a curved portion of more than ninety degrees, said die and its formed groove adapted to receive an end of a wire bail and as the wire end is moved through said curling die the wire is bent into a loop with the loop end of said wire bail exiting at a determined position;

a metal backup member located on said plate and means for moving said backup member into said access opening between said ear and said container as and when the entering end of the bail penetrates the ear and then curves within the interior of the ear to provide a retaining loop end as the bail is moved into the ear;

cam means and engaging said curling die pivoting and change the curling die to a position adjacent the ear prior to moving the wire into and through said curling die; a cover member on said plate means on said plate connected to said cover member for actuating said cover member so as to provide a confining wall for the groove in said curling die as the wire end is being moved in said groove and to uncover said groove after the wire end has been formed and inserted into an ear;

means on said support for transporting successive containers on their bottoms to and through the bail applying mechanism, and said means for transporting including means for rotating each container until an ear of the container is brought into a desired orientation at which orientated position the container is advanced to a delivery position whereat the container is delivered to the bail applying mechanism.

13. Bail applying mechanism as in claim 12 in which said backup member is moved by a pneumatic cylinder.

14. Bail applying mechanism as in claim 12 including a guide bar mounted on said plate and disposed immediately above said transporting means so that said containers may be advanced and rotated with the guide bar disposed to engage said top and prevent unwanted lifting, said guide bar extending through the bail applying mechanism and a short distance downstream of this applying station.

15. Bail applying mechanism as in claim 14 in which there is a cutout passageway in the lower portion of the lower die and through which the guide bar passes.

16. Bail applying mechanism as in claim 15 in which the guide bar is a rectangular tubular member supported in a determined and adjustable attitude above the container.

17. Bail applying mechanism as in claim 14 including guide strips disposed above said transporting means to slidably retain the containers at or near their bottom and adapted to engage each tapered advancing container along its sides.

18. Bail applying mechanism as in claim 12 in which the plastic pails are transported by round endless belts of plastic reinforced and with said belts having a high coefficient of friction so as to engage and rotate a plastic container carried thereon.

19. Bail applying mechanism as in claim 18 in which each of the transporting belts is of plastic and with an intermediate portion of each belt carried by support guides disposed and configured to provide a support, a slide and a guide for each belt.

20. Bail applying mechanism as in claim 19 in which there are only two transporting belts and means for orientating the container is a rub rail arranged to engage an ear of the container and with the ear in engagement with a rail the container is advanced to a position a short distance from the applying mechanism whereat the rub rail is discontinued and the container is released and is advanced and turned so that the opposed ears are moved into the curling dies at substantially the same time.

21. Bail applying mechanism as in claim 20 including a container spacing or metering means disposed adjacent said transporting means to receive containers and release said containers with a determined spacing between successive containers.

22. Bail applying mechanism as in claim 12 in which each of the opposed ears of the plastic container is formed with its outer exterior portion absent any aperture and the backup is moved substantially normal to the plane of the container strands transporting said containers.

23. Bail applying mechanism as in claim 12 in which said transporting means includes round endless belts of rubber-reinforced and with said belts having a high coefficient of friction so as to engage and rotate a plastic container carried thereon.

* * * * *